US005731895A

United States Patent [19]

Owczarzak et al.

[11] Patent Number: 5,731,895

[45] Date of Patent: Mar. 24, 1998

[54] POST MOUNTED REFLECTOR

[75] Inventors: Ronald E. Owczarzak, South Holland; William J. Cienkus, Jr., Crete, both of Ill.

[73] Assignee: CHS Acquisition Corp., Chicago Heights, Ill.

[21] Appl. No.: 631,674

[22] Filed: Apr. 9, 1996

[51] Int. Cl.[6] ..... G02B 5/12

[52] U.S. Cl. ..... 359/515; 359/532; 359/547; 359/552; 116/63 R; 404/9

[58] Field of Search ..... 359/515, 531, 359/532, 547, 551, 552; 116/63 R, 63 P, 63 C, 63 T; 404/9, 12, 14, 16

[56] References Cited

U.S. PATENT DOCUMENTS

| | | | |
|---|---|---|---|
| 413,730 | 10/1889 | Palmer . | |
| 2,149,844 | 3/1939 | George . | |
| 4,395,155 | 7/1983 | Bartolotti et al. | 359/547 |
| 4,623,756 | 11/1986 | Wilson, Jr. . | |
| 4,889,322 | 12/1989 | Wagner . | |
| 4,936,550 | 6/1990 | Wickham . | |
| 5,356,101 | 10/1994 | Malloy . | |

FOREIGN PATENT DOCUMENTS

| | | |
|---|---|---|
| 1252395 | 12/1960 | France . |
| 320203 | 5/1957 | Germany . |

*Primary Examiner*—James Phan
*Attorney, Agent, or Firm*—Jones, Day, Reavis & Pogue

[57] ABSTRACT

A reflective element mountable to a post comprises a body member having an internal keyway formed therein for sliding over the post. A bore is provided, preferably transversely through the body member, and is dimensioned to receive either a pin or a bolt which locks the element to the post. The body member in preferred form is cylindrical in shape. A reflective material such as in sheet form is wrapped around the outer surface of the body member. Thereby, the element is capable of reflecting light incident on its surface from 360 degrees around the element. The body of the element may be readily manufactured from a non-corroding plastic material as to provide years of service. By the construction of the element, it is also easily attached to a typical post used as a highway marker, such as a studded T-post.

18 Claims, 1 Drawing Sheet

POST MOUNTED REFLECTOR

BACKGROUND OF THE INVENTION

1. Field of the Invention

The present invention relates generally to a post mounted light reflective member, and more particularly, to a light reflective member which is conveniently attachable to a post and which reflects light which is incident on the member from all directions.

2. Description of the Prior Art

Reflective devices of all types having long been used to mark the identity of an object or a hazard by reflecting incident light rays in low ambient light conditions. Such devices have become particularly useful in the field of highway safety wherein reflective devices serve to retro-reflect headlight beams of vehicles in nighttime conditions and mark, for example, the edge of the highway pavement or shoulder. Often such highway markers comprise a post which is driven into the ground near the edge of the pavement or shoulder and having a light reflective device attached to the top of the post. A reflective device for use in such application typically comprises a metallic disk, or the like, with a lens fixed thereto having reflective cells which retro-reflect incident light rays in darkness.

A disadvantage of known reflective devices used as markers in association with posts is that these devices typically retro-reflect light rays only through a relatively small angle of incidence. Thus, the marker is capable of being seen by the driver of a vehicle, for example, only through a small angle as the vehicle approaches the marker. As a consequence, in some applications of highway marker posts where it is preferable to have a wide angle of reflective capability, such as with bridge markers, for example, multiple reflective elements must be mounted on the post in order to obtain the desired wide angle of reflectability. In such cases, the process of mounting the reflective elements to the posts can involve considerable labor adding to the cost associated with installing the markers.

Accordingly, it is desirable to provide a reflective device for use with a marker post which is convenient to mount on the marker post but also has the capability of reflecting incident light rays through a wide angle of incidence. It is further desirable to provide such a device which is easily manufactured and can be produced at low cost. Still further, it is desirable to provide such a device which is resistant to the elements and, in particular, to corrosive effects of highway salt and other exposure.

SUMMARY OF THE INVENTION

The present invention overcomes the disadvantages of the prior art by providing a reflective element mountable to a post and comprising a body member having an internal keyway formed therein for sliding over the post. A bore is provided, preferably transversely through the body member, and is dimensioned to receive either a pin or a bolt which locks the element to the post. The body member in preferred form is cylindrical in shape. A reflective material such as in sheet form is wrapped around the outer surface of the body member. Thereby, the element is capable of reflecting light incident on its surface from 360 degrees around the element. The body of the element may be readily manufactured from a non-corroding plastic material as to provide years of service. By the construction of the element, it is also easily attached to a typical post used as a highway marker, such as a studded T-post.

BRIEF DESCRIPTION OF THE DRAWINGS

The foregoing and other novel features and advantages of the invention will be better understood upon a reading of the following detailed description taken in connection with the accompanying drawing wherein.

DETAILED DESCRIPTION OF THE PREFERRED EMBODIMENTS

Figure 1:
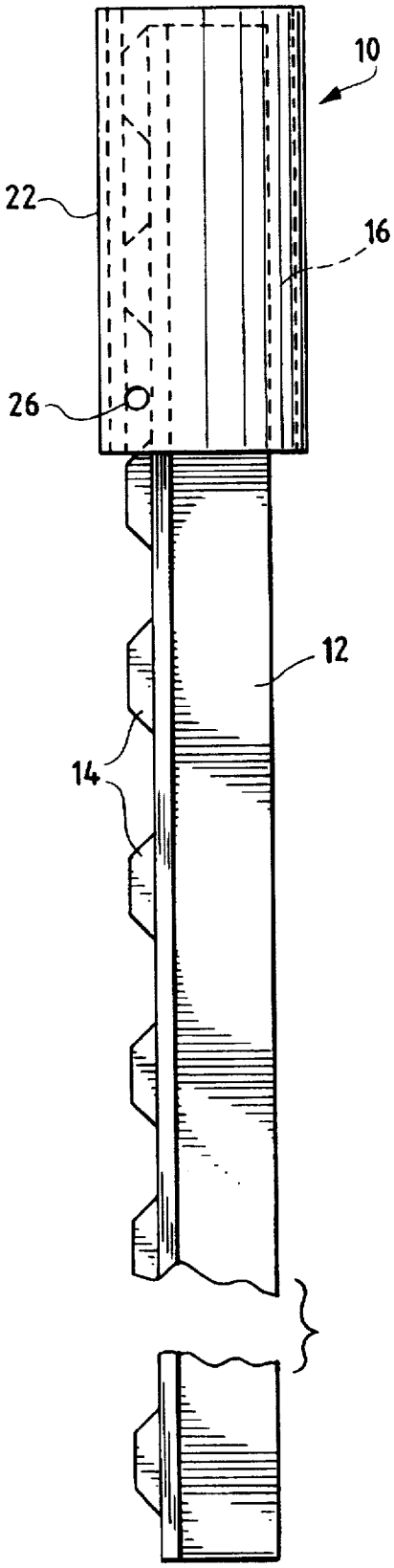
FIG. 1 is a side view of a reflective element constructed in accordance with the present invention and shown as mounted on an associated post.

Referring now to the drawing, and initially to FIG. 1, a reflective element for use as a post-mounted highway marker or the like is designated generally by the reference numeral 10 and is shown as mounted on a post 12. The illustrated post 12 is of a readily available type used for highway markers or fence posts known as a studded T-post. This type of post has a generally T-shaped cross-section with studs 14 projecting from one side at regularly spaced intervals. Studded T-posts are well known for their strength in bending and torsion. They are typically made of steel and have a relatively long life even when exposed to the elements.

Figure 2:
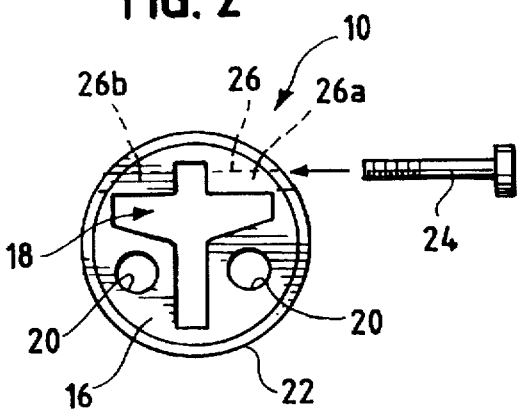
FIG. 2 is an end view of the reflective element illustrating one form of attachment means.
Figure 3:
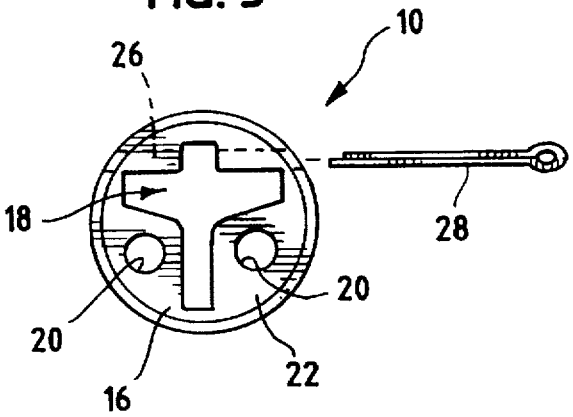
FIG. 3 is an end view of the reflective element illustrating a second form of attachment means.

As best seen in the end views of FIGS. 2 and 3, the reflective element 10 comprises as a principal component a generally cylindrical body member 16 having axially extending internal keyway 18 which is preferably sized and shaped to slidingly receive the post 12 but prevent rotational movement of the reflective element 10 relative to the post 12. The body member 16 may also be provided with through bores 20 which serve to reduce material used in its construction. The body member 16 in the illustrated embodiment is covered completely over its outer cylindrical surface with a layer of light reflective sheet material 22.

In order to secure the element 10 to the post 12, FIG. 2 shows the use of a suitable bolt 24 which is received by a laterally extending through bore 26 offset from the main part of the keyway 18 and in alignment with the studs 14 of the post 12. The bore 26 may be formed with a first portion **26*a* having a diameter sized to slidingly receive the bolt 24 while having a second portion 26*b* formed with internal threads. When the element 10 is installed on the post 12, the bore 26 may be aligned with a space between any two adjacent studs 14 such that the bolt 24 may be threaded into the bore 26 serving to cooperate with the studs 14 to limit axial movement of the reflective element 10 relative to the post 12. In FIG. 3, a second form of attachment is illustrated showing the use of a simple cotter pin 28 which functions like the bolt 24 to limit axial movement of the element 10 relative to the post 12**.

It can now be appreciated that a reflective element 10 constructed in accordance with the invention offers considerable advantages in constructing highway markers, or the like. The body member 16 may readily be manufactured from a suitable extruded or molded plastic of any known composition exhibiting resistance to sunlight and corrosion by the elements. The element 10 can be seen to be easily attached to a standard T-post 12 with few tools. Moreover, once attached, it has the capability of reflecting light rays incident from all directions around its circumference. Hence, it is most suitable for use in applications where wide angles of reflectivity are desired.

Although the body member 16 of the illustrated embodiment is shown as cylindrical in shape, other shapes may be advantageously used such as triangular or square. Further, the internal keyway 18 need not be formed in the identical cross-sectional shape of the post 12, so long as the element 10 is maintained such that the bolt 24 or pin 28 stays in alignment with the studs 14 and prevents axial movement of the element 10 relative to the post 12. Also, posts other than studded T-posts 12 may be used such as U-shaped posts having suitable apertures for receiving an attachment pin or bolt. The illustrated embodiment shows the use of reflective sheet material 22, which may advantageously be of a self-adhesive type. However, many other forms of reflective means can be used. For example, reflective coatings are known which may be sprayed on the outer surface of the body member 16. Also, known retro-reflective devices of various types may be attached or adhered to the body member 16 at desired positions around its periphery. Another advantage of the element 10 when constructed for attachment by a bolt 24, is that the bore portion **26*b* need not be threaded to receive the bolt 24, particularly if the body portion 16 is formed from plastic. The bore portion 26*b* may simply be formed of such an internal diameter that the bolt 24 can be self-tapping into the bore 26*b*. Thus, it can be appreciated that the element 10** can be readily manufactured at low cost, it is simple and convenient to install, and it is highly effective for use in such applications as marking bridges, highways, or the like.

While the present invention has been described in connection with certain preferred embodiments thereof, it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. A reflective element mountable to a post, comprising:

a body member having an outer surface;

an internal keyway formed in said body member, said keyway being dimensioned and configured to slidingly receive a post; and means receivable in a bore of said body member and engageable with said post for limiting longitudinal movement of said body member relative to said post;

said body member having optically reflective means on said surface for reflecting incident light directed thereat.

2. The reflective element of claim 1 wherein said keyway is dimensioned and configured to limit rotational movement of said body member about the longitudinal axis of said post.

3. The reflective element of claim 1 wherein said keyway has a cross-section similar in shape to the cross-section of said post.

4. The reflective element of claim 1 wherein said means for limiting movement of said body member is a pin.

5. The reflective element of claim 1 wherein said means for limiting movement of said body member is a bolt.

6. The reflective element of claim 5 wherein said bore has a first portion which slidingly receives said bolt and a second portion which threadedly receives said bolt.

7. The reflective element of claim 6 wherein said second bore portion is self-tapping.

8. The reflective element of claim 1 wherein said reflective means comprises a sheet of reflective material.

9. The reflective element of claim 8 wherein said sheet is wrapped substantially completely around said body member.

10. The reflective element of claim 1 wherein said body member is cylindrical in shape with said keyway running lengthwise thereof.

11. The reflective element of claim 1 wherein said post is a studded T-post having lugs projecting outward thereof at spaced intervals and said means for limiting movement of said body member cooperates with a pair of said lugs to limit said movement.

12. The reflective element of claim 11 wherein said keyway is generally T-shaped in cross-section.

13. The reflective element of claim 1 wherein said reflective means is a reflective coating on said outer surface of said body member.

14. The reflective element of claim 1 wherein said bore extends transversely through said body member.

15. A reflective element mountable to a post for use as a highway marker comprising:

a generally cylindrical body member having an internal keyway formed therein, said keyway being dimensioned and configured to slidingly receive a post and having a cross-sectional shape cooperating with the cross-sectional shape of the post to limit rotational movement of said body member about the longitudinal axis of the post;

means cooperable between the body member and a post to limit longitudinal movement of the body member relative to the post; and means provided on the surface of said body member for reflecting rays of incident light.

16. The reflective element of claim 15 wherein said means for limiting longitudinal movement of said body member includes a pin extending transversely through said body member.

17. The reflective element of claim 15 wherein said reflecting means includes a sheet of reflective material.

18. The reflective element of claim 17 wherein said reflective material is wrapped completely around the surface of said body member.

* * * * *